US006694557B1

(12) United States Patent
Bobey et al.

(10) Patent No.: US 6,694,557 B1
(45) Date of Patent: Feb. 24, 2004

(54) BARIATRIC BED

(75) Inventors: John A. Bobey, Daniel Island, SC (US); John A. Brenner, Ladson, SC (US); Sam Crumlish, Mt. Pleasant, SC (US); Kenneth A. Fox, Charleston, SC (US); Benjamin Salvatini, Summerville, SC (US); James H. Price, Mt. Pleasant, SC (US)

(73) Assignee: Hill-Rom Services, Inc., Wilmington, DE (US)

( * ) Notice: Subject to any disclaimer, the term of this patent is extended or adjusted under 35 U.S.C. 154(b) by 276 days.

(21) Appl. No.: 09/669,705

(22) Filed: Sep. 26, 2000

Related U.S. Application Data

(60) Continuation of application No. 09/266,959, filed on Mar. 12, 1999, now Pat. No. 6,141,806, which is a division of application No. 08/883,516, filed on Jun. 26, 1997, now Pat. No. 5,894,966.

(51) Int. Cl.[7] ..... A47C 27/08
(52) U.S. Cl. ..... 5/714; 5/663; 5/425
(58) Field of Search ..... 5/600, 648, 734, 5/712, 663, 425, 613, 731, 713, 714, 615, 710, 624

(56) References Cited

U.S. PATENT DOCUMENTS

| | | | | | |
|---|---|---|---|---|---|
| 421,656 | A | | 2/1890 | Blanken | |
| 2,016,054 | A | | 10/1935 | Sentell | |
| 3,339,544 | A | | 9/1967 | Kravitz | |
| 3,656,665 | A | | 4/1972 | Fleming et al. | |
| 3,822,425 | A | * | 7/1974 | Scales | 5/714 |
| 4,188,677 | A | | 2/1980 | Zur | |
| 4,214,326 | A | | 7/1980 | Spann | |
| 4,215,446 | A | | 8/1980 | Mahoney | |
| 4,243,024 | A | | 1/1981 | Crosbie et al. | |
| 4,269,213 | A | | 5/1981 | Sasaki | |
| 4,270,233 | A | | 6/1981 | Mulligan | |
| 4,376,317 | A | | 3/1983 | Johnston | |
| 4,409,695 | A | | 10/1983 | Johnston et al. | |
| 4,472,847 | A | * | 9/1984 | Gammons et al. | 5/714 |
| 4,577,358 | A | | 3/1986 | Glass | |
| 4,654,903 | A | | 4/1987 | Chubb et al. | |
| 4,672,698 | A | | 6/1987 | Sands | |
| 4,787,104 | A | | 11/1988 | Grantham | |
| 4,796,948 | A | | 1/1989 | Paul et al. | |
| 4,941,221 | A | | 7/1990 | Kanzler | |
| 5,035,014 | A | | 7/1991 | Blanchard | |
| 5,044,025 | A | | 9/1991 | Hunsinger et al. | |
| 5,052,065 | A | | 10/1991 | West | |
| 5,097,550 | A | | 3/1992 | Marra, Jr. | |
| 5,134,739 | A | * | 8/1992 | Gaffe et al. | 5/648 |
| 5,154,185 | A | | 10/1992 | Latimer et al. | |
| 5,168,589 | A | * | 12/1992 | Stroh et al. | 5/714 |
| 5,170,364 | A | | 12/1992 | Gross et al. | |
| 5,175,897 | A | | 1/1993 | Marra, Jr. | |
| 5,191,663 | A | | 3/1993 | Holder et al. | |
| 5,251,347 | A | | 10/1993 | Hopper et al. | |
| 5,394,577 | A | | 3/1995 | James et al. | |
| 5,408,710 | A | | 4/1995 | Garman et al. | |
| 5,454,126 | A | | 10/1995 | Foster et al. | |
| 5,473,313 | A | | 12/1995 | Graebe, Jr. | |
| 5,479,666 | A | | 1/1996 | Foster et al. | |
| 5,481,772 | A | | 1/1996 | Glynn et al. | |
| 5,509,155 | A | * | 4/1996 | Zigarac et al. | 5/714 |
| 5,513,899 | A | | 5/1996 | Michaels et al. | |
| 5,557,817 | A | | 9/1996 | Haddock | |
| 5,564,520 | A | | 10/1996 | Forsythe | |
| 5,579,544 | A | | 12/1996 | Attler | |
| 5,603,133 | A | | 2/1997 | Vrzalik et al. | |
| 5,630,238 | A | | 5/1997 | Weismiller et al. | |
| 5,745,939 | A | | 5/1998 | Flick et al. | |
| 5,771,506 | A | | 6/1998 | Joiner | |
| 5,806,115 | A | | 9/1998 | Brown | |
| 5,864,900 | A | | 2/1999 | Landau | |
| 5,960,493 | A | * | 10/1999 | Rhey et al. | 5/424 |

* cited by examiner

*Primary Examiner*—Anthony Knight
*Assistant Examiner*—James M. Hewitt
(74) *Attorney, Agent, or Firm*—Bose McKinney & Evans LLP

(57) ABSTRACT

A low air loss bladder coupled to a siderail is provided.

38 Claims, 6 Drawing Sheets

BARIATRIC BED

This application is a continuation of U.S. application Ser. No. 09/266,959, filed Mar. 12, 1999, now U.S. Pat. No. 6,141,806, which is a divisional of U.S. application Ser. No. 08/883,516, filed Jun. 26, 1997, now U.S. Pat. No. 5,894,966.

BACKGROUND SUMMARY OF THE INVENTION

The present invention relates to a bariatric bed. More particularly, the present invention relates to improved patient support surfaces for use on a bed and an improved apparatus for controlling inflation and deflation of support surfaces on the bed.

Bariatric beds are designed for use by obese patients. Bariatric beds typically include a very heavy duty frame and side rails which can be pivoted outwardly to accommodate large patients. Obese patients confined to a bed for a long period of time are particularly susceptible to skin chafing which can lead to skin sores.

One area of an obese patient's body that is particularly susceptible to chafing is between the patient's legs. Often a caregiver will place items such as a towel between the patient's legs to keep them from rubbing together. The present invention is designed to provide an improved air cushion to reduce the likelihood of skin chafing in the legs of a patient.

According to one aspect of the present invention, a cushion is provided for supporting legs of a patient on a bed. The cushion includes an air bladder having a bottom surface, a side wall, and a contoured top surface. The top surface of the air bladder has a central elevated portion configured to define first and second spaced apart zones for receiving and separating first and second legs, respectively, of the patient.

In the illustrated embodiment, the top surface includes opposite first and second elevated side portions. The central elevated portion is located between the first and second side elevated portions to form first and second recessed portions therebetween for receiving the first and second legs, respectively.

The air bladder includes a front edge and a rear edge. The first and second side elevated portions and the central elevated portion extend between the front edge and the rear edge of the top surface. In the illustrated cushion, at least one strap is coupled to the bottom surface of the air bladder. The at least one strap is configured to couple the air bladder to a deck of a bed.

Typically, when the siderails of a bed are pivoted outwardly to accommodate an obese patient, foam blocks or pillows are positioned between the patient and the siderails. Such supports tend to move and also tend to cause perspiration which can lead to skin problems. The present invention also provides an improved support surface for supporting sides of the patient.

According to another aspect of the present invention, a cushion apparatus is provided for use on a bed having a frame, a body support surface located on the frame, a siderail coupled to the frame, and an air supply. The cushion apparatus includes at least one low air loss air bladder coupled to the siderail of the bed. The low air loss bladder is also coupled to the air supply. The air bladder includes at least one strap configured to couple the air bladder to the siderail.

The present invention also provides an improved apparatus for deflating air cushions on the bed. Particularly, the apparatus of the present invention automatically deflates a foot cushion of the bed as the bed frame moves to a chair orientation using a mechanical valve.

According to yet another aspect of the present invention, a cushion is provided for use on a foot section of an articulating deck of a bed to support the legs of a person on the bed. The foot section of the deck is movable from a generally horizontal bed position to a generally vertical chair position. The cushion includes an air bladder configured to be inflated when the deck is in its horizontal bed position and deflated when the deck is in its generally vertical chair position, a cover surrounding the air bladder, and an elastic cord coupled to the cover. The elastic cord is configured to gather the cover and the air bladder toward the foot section of the deck as the air bladder is deflated.

The illustrated cover includes a front wall, a rear wall, and spaced apart first and second side walls. The cord has a first end coupled to the rear wall of the cover adjacent the first side wall. The cord extends to the front wall adjacent the first side wall and is coupled to and extends along the front wall of the cover between the first and second side walls. A second end of the cord is coupled to the rear wall of the cover adjacent the second side wall.

In the illustrated embodiment, the elastic cord is stretched when the air bladder is inflated and retracted when the air bladder is deflated. The cover includes a bottom cover portion and a top cover portion coupled to the bottom cover portion.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
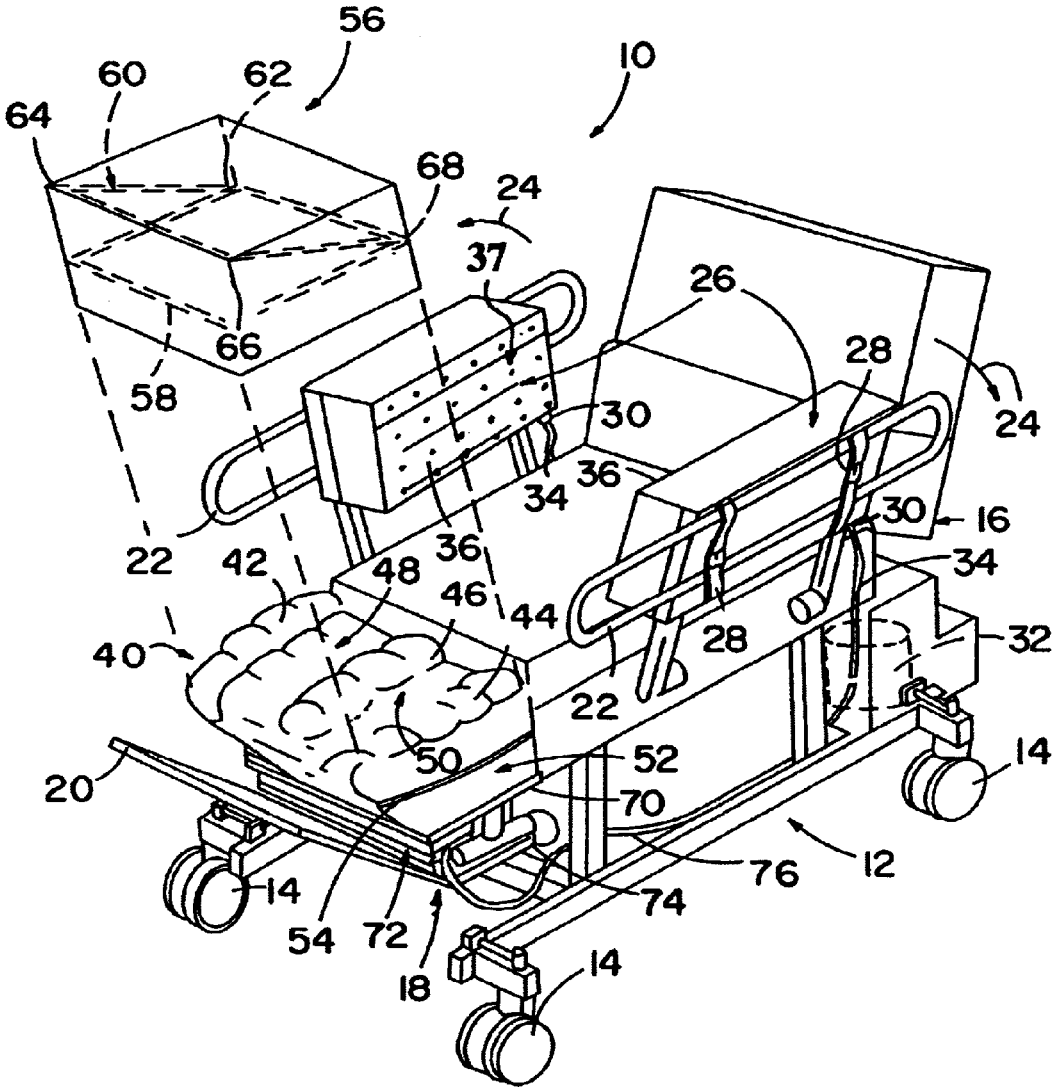
FIG. 1 is a perspective view of a bariatric bed of the present invention illustrating a bed frame having improved siderail cushions, a contoured foot cushion air bladder, and a mechanical dump valve coupled between a blower apparatus and the foot cushion air bladder to deflate the foot cushion automatically when a deck foot section of the bed moves to a chair position.

Referring now to the drawings, FIG. 1 illustrates a bariatric bed 10 having a bed frame 12 including castors 14 for moving the bed 10. An articulating deck 16 is mounted to the frame 12. Deck 16 includes a foot deck section 18. A foot prop 20 is pivotably coupled to the foot deck section 18.

The bed also includes pivotable siderails 22 on opposite sides of the bed 10. The siderails 22 are pivotable relative to frame 12 to an outwardly pivoted position in the direction of arrows 24 to accommodate large patients on the bed 10. Typically, cushions such as foam blocks or pillows are wedged between the patient and siderails 22 in order to improve comfort for the patient and to prevent the patient from rubbing against siderails 22.

The present invention provides a low air loss air bladder 26 coupled to each siderail 22 by suitable fasteners such as straps 28. Each low air loss bladder 26 includes an air inlet connection 30 which is coupled to a blower 32 on bed frame 12 by tubes 34. The low air loss air bladders allow a limited supply of air to escape through at least the inwardly facing surfaces 36 of air bladders 26. Low air loss air bladders 26 provide improved support and comfort for the patient on the bed 10 and stay in position on the siderails 22. In addition, the low air loss air bladders 26 adjacent the sides of the patient provide a cooling air flow to dry perspiration of the patient. In an illustrated embodiment, at least the inwardly facing surfaces 36 of the low air loss bladders 26 are formed to include a plurality of holes 37 which allow a limited supply of air to escape through the inwardly facing surfaces 36. In another embodiment, at least the inwardly facing surfaces 36 are formed from an air permeable material.

The bariatric bed 10 of the present invention includes a contoured air bladder foot cushion 40. The foot cushion 40 includes elevated side portions 42 and 44 and an elevated center portion 46 located between the side portions 42 and 44 to define first and second recesses 48 and 50 for receiving first and second legs of a patient. The contoured top surface 152 of foot cushion 40 holds the legs of the patient spaced apart from each other to reduce chafing. The air cushion 40 is covered by a cleanable plastic bottom cover 52 having a top zipper 54. A top cover 56 includes a zipper 58 to connect the top cover 56 to bottom cover 52. As discussed in detail below, the top cover 56 also includes an elastic cord 60 having a first end coupled to a first side 62 of the top cover 56. Cord 60 stretches to a top left corner 64 of cover 56 and across the cover to the top right corner 66. A second end of cord 60 is coupled to cover 56 adjacent zipper 58 on second side 68. The elastic cord 60 is expanded when foot cushion 40 is inflated. Therefore, when foot cushion 40 is deflated, the cord 60 retracts and draws the cover 56 and the deflated foot cushion 40 inwardly toward a support surface 70 of foot deck section 18.

In the illustrated embodiment, the foot deck support surface 70 is supported on a bellows 72 which can be inflated and deflated to control the height of the support surface 70 relative to the deck section 18. A dump valve 74 is connected to support surface 70 to control inflation and deflation of foot surface air cushion 40. It is understood that the foot cushion 40 and dump valve 74 may be used with any articulating deck, with or without the bellows 72.

Dump valve 74 includes as opening 104 connected to foot cushion 40 as discussed below. An inlet of dump valve 74 is coupled to blower 32 by tube 76.

Figure 2:
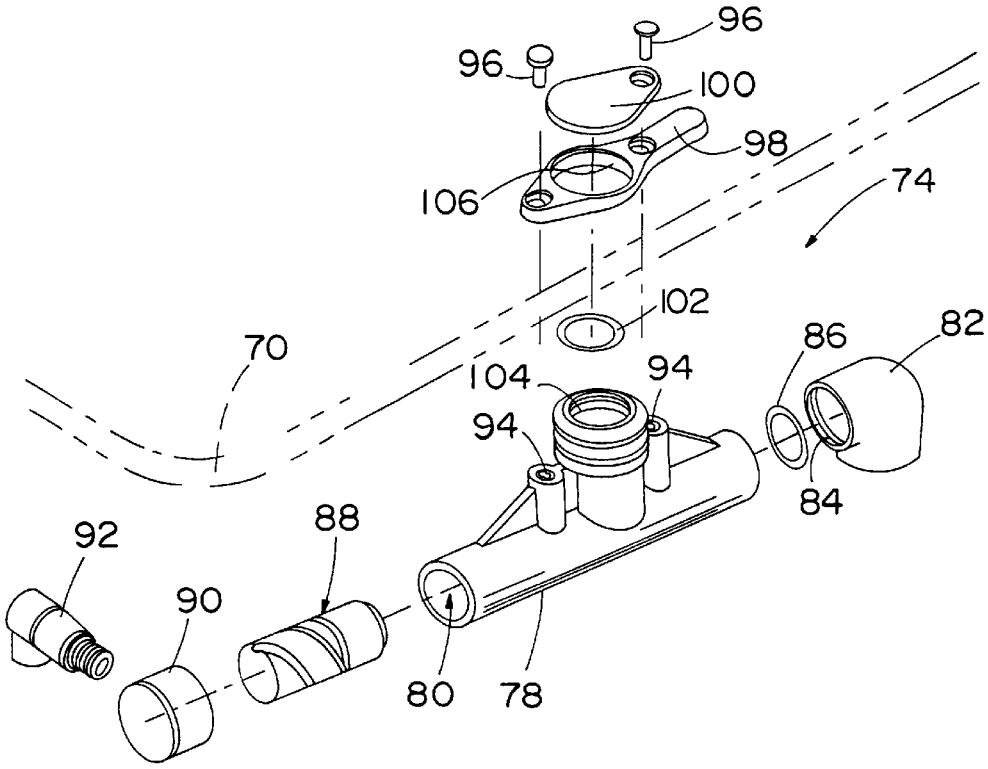
FIG. 2 is a perspective view of the dump valve apparatus of the present invention.
Figure 3:
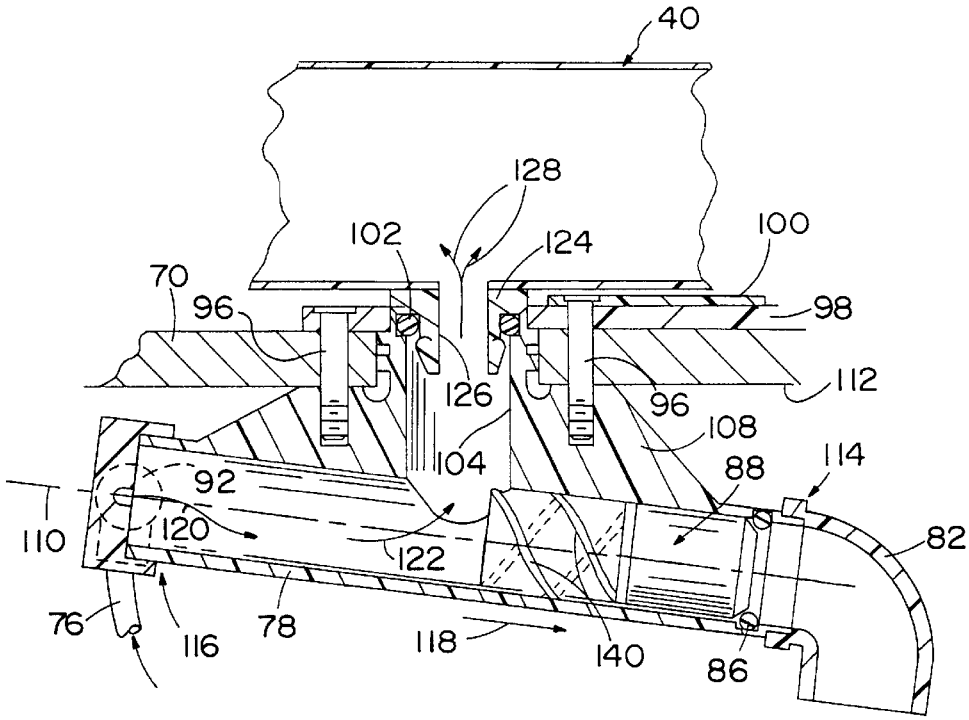
FIG. 3 is a sectional view taken through the dump valve apparatus when the foot section of the bed deck is located in a generally horizontal orientation to provide a bed for a patient.
Figure 4:
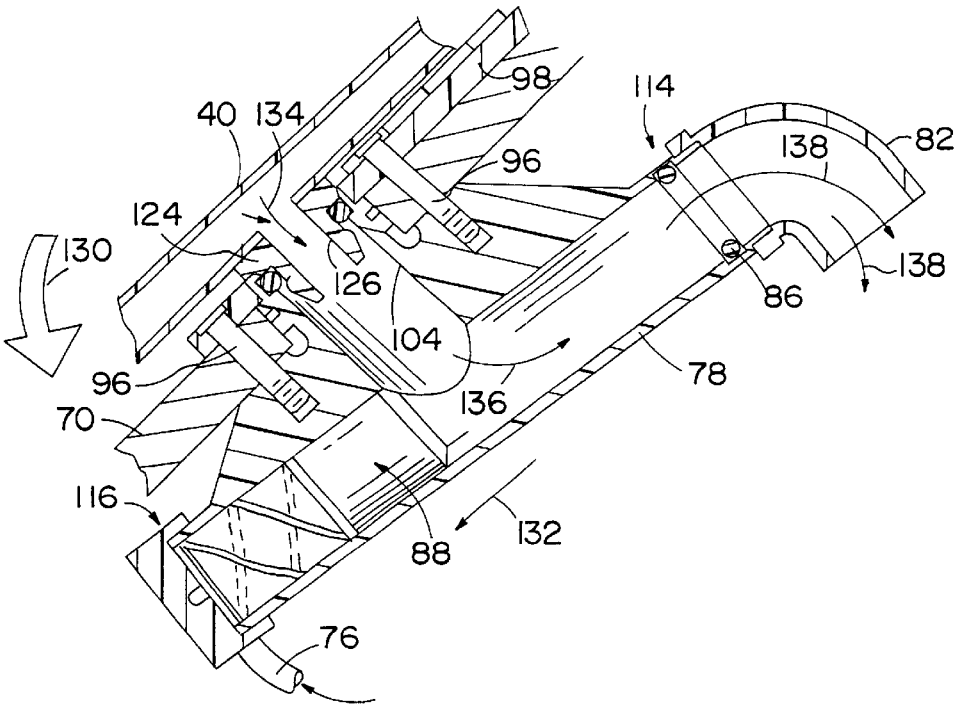
FIG. 4 is a sectional view similar to FIG. 3 illustrating movement of the foot deck section downwardly toward to a generally vertical position and illustrating a piston movable within the dump valve housing to vent the foot cushion air bladder to atmosphere and deflate the foot cushion air bladder.

Details of the dump valve apparatus 74 of the present invention are illustrated in FIGS. 2–4. As shown in FIG. 2, the dump valve 74 includes an elongated cylindrical housing 78 having an interior region 80. An L-shaped elbow 82 is coupled to outlet end 114 of housing 78 by threads 84. An O-ring seal 86 is located between the housing 78 and the elbow 82. Elbow 82 provides a downwardly directed outlet opening to prevent fluids from splashing into dump valve 74.

A piston 88 is located within interior region 80 of housing 78 to open and close the dump valve 74 as discussed in detail below. Piston 88 is formed from a metal material such as copper or another suitable material having a density great enough for the piston 88 to move within the housing 78 to open and close the dump valve 74. Preferably, piston 88 is electroplated with nickel or other suitable material to prevent corrosion and reduce friction of the piston 88 within the housing 78.

An end cap 90 is threadable coupled to an inlet end 116 of housing 78. End cap 90 includes an aperture for receiving an air fitting 92 for coupling the inlet end 116 of the dump valve 74 to the blower 32 with tube 76.

A top mounting portion of housing 78 includes threaded apertures 94 for receiving fasteners 96 to couple the dump valve 74 to a suitable surface such as foot deck support surface 70. A mounting plate 98 is located above the support surface 70. A swivel cap 100 is located above mounting plate 98. An O-ring seal 102 is provided to seal a central opening 104 of housing 78. Swivel plate 100 is used to cover aperture 106 in mounting plate 98 and central opening 104 when the dump valve 74 is not in use.

Operation of the dump valve 74 is best illustrated in FIGS. 3 and 4. As shown in FIG. 3, the housing 78 includes a mounting portion 108 configured to align a longitudinal axis 110 of housing 78 at an angle with respect to a bottom planar surface 112 of support deck surface 70. Therefore, when support surface 70 is in a horizontal bed position of FIG. 3, the longitudinal axis 110 of housing 78 is aligned so that the outlet end 114 of housing 78 is located below inlet end 116. Therefore, piston 88 slides downwardly due to gravity toward outlet end 114 of housing 78 in the direction of arrow 118.

In the FIG. 3 position, piston 88 permits inlet air from blower 32 to pass through tube 76 and fitting 92 into inlet end 116 of housing 78 in the direction of arrow 120. Piston 88 blocks air flow through the open outlet end 114 of housing 78. Therefore, air moves upwardly in the direction of arrow 122 through opening 104. Foot surface section 40 includes a connector 124 coupled to a top end of opening 104 and sealed by O-ring 102. Connector 124 includes an internal passageway 126 to permit air flow from opening 104 into air cushion 40 in the direction of arrows 128. Therefore, when the deck 70 is in the generally horizontal position of FIG. 3, the blower 32 supplies air through the dump valve 74 to an interior region of air cushion 40.

When deck 70 is moved away from its horizontal position of FIG. 3 toward a generally vertical chair position in the direction of arrow 130 as shown in FIG. 4, piston 88 slides within housing 78 due to gravity in the direction of arrow 132 toward the inlet end 116 of housing 78. Piston slides past central opening 104 in housing 78 to block air flow from inlet tube 76. Therefore, air from inside air cushion 40 flows through passageway 126 of connector 124 in the direction of arrows 134. Air flows downwardly through opening 104 in the direction of arrow 136 and then through open outlet end 114 of housing 178 and elbow connector 82 in the direction of arrows 138 in order to deflate the air cushion 40.

The piston 88 is formed to include a helical groove 140. The helical groove 140 provides an air bearing surface to help the piston 88 slide back and forth within housing 78 without binding.

The dump valve 74 provides a mechanical apparatus for controlling inflation and deflation of the air cushion 40 based on articulation of deck section 70. It is understood that the dump valve 74 may be used with any portion of articulating deck of the bed 10. In addition, the dump valve 74 may be mounted on the opposite side of deck 70 if desired.

In certain instances, it is desirable to switch the location of the elbow connector 82 with the end cap 90 and air inlet connector 92. In this instance, an air bladder coupled to central opening 140 is normally deflated when the associated deck section is in the horizontal position. As the deck moves to an angled position, either upwardly or downwardly, the piston 88 slides toward end 116 of housing 78 to permit air to flow into the housing 78 and central aperture to inflate the air bladder. This modified configuration may be useful to selectively inflate a bladder in the seat section of the bed as the bed moves to the chair orientation to reduce the likelihood that the patient will bottom out against the frame of the bed. In this instance, the cushion in the seat or other location may be normally deflated or inflated to a certain level until the bed deck articulates to raise the head section or lower the foot section of the deck. Upon raising or lowering of the section to which the dump valve 74 is connected, the piston 88 moves downwardly as shown in FIG. 4. However, since the air inlet hose 76 is coupled to end 114 of housing 78 in this modified embodiment, air flows to the air bladder coupled to connector 124. This inflates the air bladder or increases the pressure in a partially inflated bladder.

It is understood that the air bladder coupled to dump valve 74 may be spaced apart from the connector 124. In this instance, an air supply tube is used to connect the connector 124 with the remote air bladder.

Figure 5:
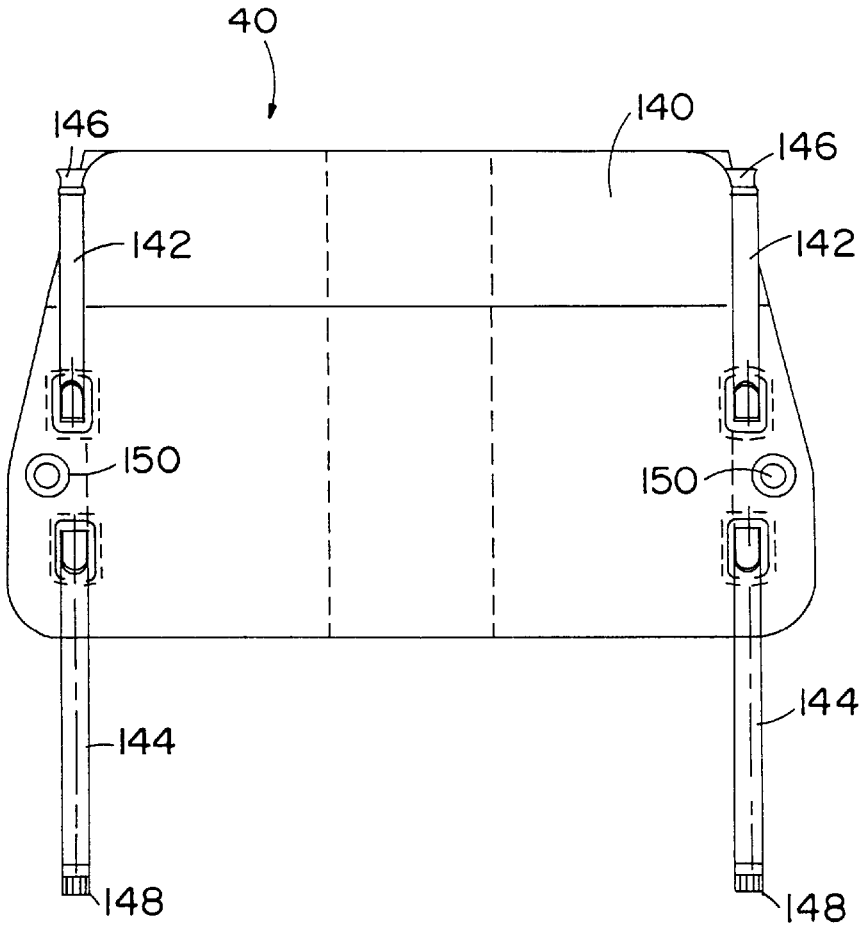
FIG. 5 is a bottom plan view illustrating the foot cushion air bladder.

Further details of the contoured foot cushion 40 are illustrated in FIGS. 5–8. FIG. 5 illustrates a bottom surface 140 of foot cushion 40. A pair of straps 142 and 144 are coupled to opposite sides of bottom surface 140. A female connector 146 is coupled to each strap 142, and a male connector 148 is coupled to each strap 144. Air can be supplied to foot cushion 40 through an opening 150 provided in either side of the foot section bottom surface 140. Only one opening 150 is used at a time. The other opening is sealed. The straps 142 and 144 wrap around the deck support surface 70 to connect the foot cushion 40 to the support surface 70.

Figure 6:
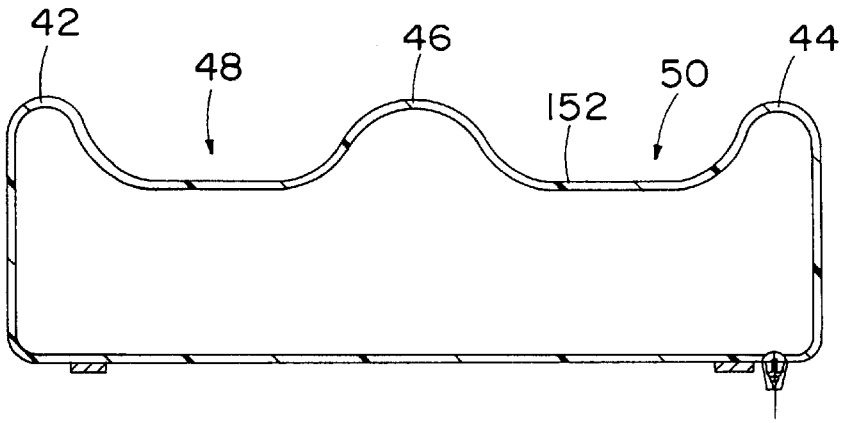
FIG. 6 is a sectional view taken through the foot cushion air bladder illustrating a contoured profile of a top surface of the air bladder.

FIG. 6 illustrates the contoured shape of top surface 152. Top surface 152 of air cushion 40 is formed using a RF welding technique with specially cut baffles to define the elevated side portions 42 and 44 and the elevated central portion 46 which defines first and second recesses 48 and 50 for receiving and separating first and second legs of the patient. By separating the patient's legs, the contoured foot cushion 40 of the present invention reduces chafing of the legs which can lead to skin sores.

Figure 7:
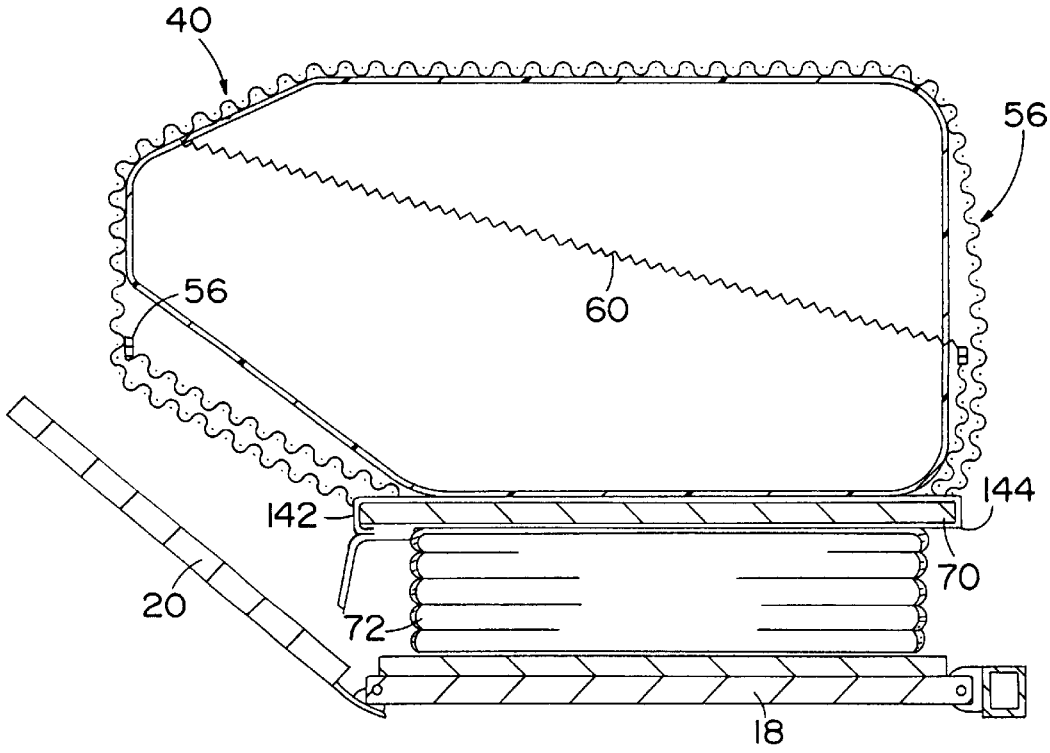
FIG. 7 is a sectional view taken through the foot section of FIG. 1 illustrating a foot cushion with a cover installed over the foot air bladder with the deck of the bed in a generally horizontal bed position.
Figure 8:
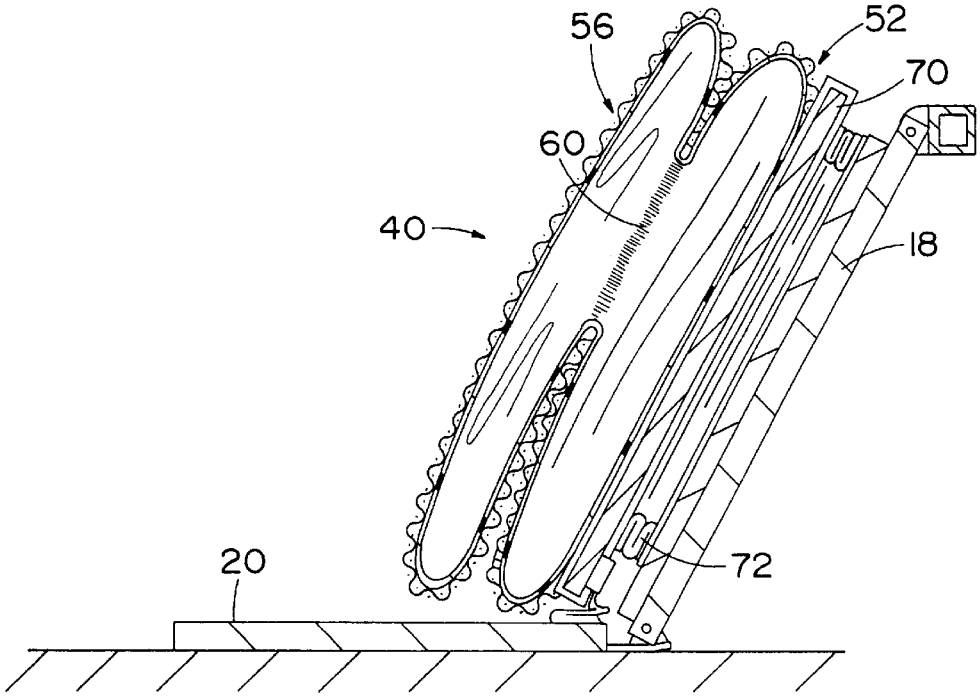
FIG. 8 is a sectional view similar to FIG. 7 illustrating movement of the foot deck section of the bed into a generally vertical chair position in which the foot cushion air bladder is deflated and retracted by an elastic cord in the cover to move the foot surface air bladder toward the deck of the bed.

FIGS. 7 and 8 illustrate the contoured foot cushion 70 covered by bottom cover 52 and top cover 56. FIGS. 7 and 8 also further illustrate the bellows 72 connected between deck section 18 and foot deck support surface 70. When deck section 18 is in its horizontal bed position, the bellows 72 can be adjusted to control the position of deck support surface 70 and foot cushion 40.

FIG. 7 illustrates that elastic cord 60 extends from a first side 62 upwardly toward the front wall of top cover 56 as also illustrated in FIG. 1. Elastic cord 60 is stretched when the foot cushion air bladder 40 is inflated during normal operation in the bed position. When the bed deck section 18 is pivoted downwardly to the chair position as shown in FIG. 8, the air bladder 40 is deflated by dump valve 74 as discussed above. The elastic cord 60 within cover 56 retracts as the cushion 40 deflates to gather the cover 56 and the deflated air bladder 40 upwardly over itself and toward the support surface 70. This gathering keeps the deflated foot cushion 40 and cover 56 from falling onto foot prop 20 so that the deflated cushion 40 and cover 56 are out of the way of a patient's fee when the bed is in the chair position.

Although the invention has been described in detail with reference to certain illustrated embodiments, variations and modifications exist within the scope and spirit of the present invention as described and defined in the following claims.

What is claimed is:

1. An apparatus for use on a siderail of a bed, the apparatus comprising:

an air bladder including an interior region configured to receive air from an air supply, an inwardly facing surface configured to be located adjacent a patient located on the bed, and an outwardly facing surface, the inwardly facing surface including an air permeable surface configured to permit a limited amount of air to escape from the air bladder, an air bladder-to-siderail fastener configured to couple the air bladder to a siderail, and a connector configured to couple the air bladder to the air supply.

2. The apparatus of claim 1, wherein the fastener includes at least one strap coupled to the air bladder, the at least one strap being configured to couple the air bladder to the siderail.

3. The apparatus of claim 1, wherein the air permeable surface includes a plurality holes which allow a limited supply of air to escape from the interior region through the inwardly facing surface.

4. The apparatus of claim 1, wherein the connector includes an air inlet connection coupled to the air bladder and a tube having a first end coupled to the air inlet connection and a second end configured to be coupled to the air supply.

5. The apparatus of claim 1, further comprising a leg support air bladder having a bottom surface, a side wall, and a contoured top surface, the top surface of the leg support air bladder having a central elevated portion configured to define first and second spaced apart zones for receiving and separating first and second legs, respectively, of the patient.

6. The apparatus of claim 5, wherein the top surface includes opposite first and second elevated side portions, the central elevated portion being located between the first and second side elevated portions to form first and second recessed portions therebetween for receiving the first and second legs, respectively.

7. The apparatus of claim 5, further comprising at least one strap coupled to the bottom surface of the leg support air bladder, the at least one strap being configured to couple the air bladder to a deck of a bed.

8. An apparatus for use on a siderail of a bed, the apparatus comprising an air bladder including an air permeable surface configured to permit a limited amount of air to escape from the air bladder, a fastener configured to couple the air bladder to the siderail, a connector configured to couple the air bladder to an air supply, a leg support air bladder having a bottom surface, a side wall, and a contoured top surface, the top surface of the leg support air bladder having a central elevated portion configured to define first and second spaced apart zones for receiving and separating first and second legs, respectively, of the patient, the bed including an articulating deck having a foot section that is movable from a generally horizontal bed position to a generally vertical chair position, the leg support air bladder being coupled to the foot section of the deck and configured to be inflated when the deck is in its horizontal bed position and deflated when the deck is in its generally vertical chair position, and further comprising a cover surrounding the air bladder, and an elastic cord coupled to the cover, the elastic cord being configured to gather the cover and the air bladder toward the foot section of the decks the air bladder is deflated.

9. The apparatus of claim 8, wherein the elastic cord is stretched when the air bladder is inflated and retracted when the air bladder is deflated.

10. The apparatus of claim 8, further comprising a dump valve apparatus configured to selectively inflate and deflate the leg support air bladder, the dump valve apparatus including an elongated housing having an interior region extending along a longitudinal axis, the housing having first and second open ends and a central opening located between the first and second open ends, the central opening being configured to be coupled to the leg support air bladder, a mounting portion configured to couple the housing to the foot section so that the longitudinal axis of the housing is aligned at an angle relative to the foot section to position the second end of the housing below the first end of the housing when the foot section is in its generally horizontal bed position, a connector coupled to the first end of the housing to couple the housing to an air supply, and a piston located within the interior region of the housing, the piston being slidable within the interior region of the housing from a first position adjacent the second end of the housing when the foot section is in the generally horizontal bed position to permit air to pass from the air supply into the interior region of the housing, through the central opening, and into the leg support air bladder to inflate the leg support air bladder, the piston also being slidable within the housing to a second position located adjacent the first end of the housing as the foot section moves to its generally vertical chair position so that the piston blocks air flow from the air supply into the first end of the housing, the piston permitting air to pass from the leg support air bladder, through the central opening, and through the open second end of the housing to deflate the leg support air bladder when the piston is in its second position.

11. The apparatus of claim 10, wherein the piston is formed to include a helical groove to provide an air bearing surface on the piston.

12. The apparatus of claim 10, wherein the mounting portion is formed integrally with the housing.

13. A support apparatus comprising:

a bed having a frame, a deck coupled to the frame, a support surface located on the deck, and a siderail coupled to the frame;

an air supply; and an air bladder coupled to the siderail of the bed, the air bladder also being coupled to the air supply, the bladder including an interior region configured to receive air from the air supply, an inwardly facing surface configured to be located adjacent a patient located on the bed, and an outwardly facing surface, the inwardly facing surface including an air permeable surface configured to permit a limited amount of air to escape from the air bladder.

14. The apparatus of claim 13, further comprising a fastener coupled to the air bladder, the fastener being configured to couple the air bladder to the siderail.

15. The apparatus of claim 14, wherein the fastener includes at least one strap coupled to the air bladder.

16. The apparatus of claim 13, wherein the air bladder includes an air inlet connection coupled to the air bladder and a tube having a first end coupled to the air inlet connection and a second end configured to be coupled to the air supply.

17. The apparatus of claim 13, wherein the support surface includes a leg support air bladder having a bottom surface, a side wall, and a contoured top surface, the top surface of the leg support air bladder having a central elevated portion configured to define first and second spaced apart zones for receiving and separating first and second legs, respectively, of the patient.

18. A support apparatus comprising:

a bed having a frame, a deck coupled to the frame, a support surface located on the deck, and a siderail coupled to the frame, the support surface including a leg support air bladder having a bottom surface, a side wall, and a contoured top surface, the top surface of the leg support air bladder having a central elevated portion configured to define first and second spaced apart zones for receiving and separating first and second legs, respectively of the patient; the deck having a foot section that is movable from a generally horizontal bed position to a generally vertical chair position, the leg support air bladder being coupled to the foot section of the deck and configured to be inflated when the deck is in its horizontal bed position and deflated when the deck is in its generally vertical chair position, and further comprising a cover surrounding the leg support air bladder, and an elastic cord coupled to the cover, the elastic cord being configured to gather the cover and the leg support air bladder toward the foot section of the deck as the leg support air bladder is deflated, an air supply, and an air bladder coupled to the siderail of the bed, the air bladder also being coupled to the, air supply, the bladder including an air permeable surface configured to permit a limited amount of air to escape from the air bladder.

19. The apparatus of claim 17, further comprising a dump valve apparatus configured to selectively inflate and deflate the leg support air bladder.

20. An apparatus for use on a siderail of a bed, the apparatus comprising a bladder, means for allowing a limited amount of air to escape from the bladder to provide air flow toward a person located on the bed, a bladder-to-siderail fastener configured to couple the bladder to a siderail, and a connector configured to couple the bladder to an air supply.

21. The apparatus of claim 20, wherein the fastener includes at least one strap coupled to the bladder, the at least one strap being configured to couple the bladder to the siderail.

22. The apparatus of claim 20, wherein the bladder includes an interior region configured to receive air from the air supply, an inwardly facing surface configured to be located adjacent a patient located on the bed, and an outwardly facing surface, and wherein the means for allowing a limited amount of air to escape from the bladder includes a plurality holes formed in the inwardly facing surface.

23. The apparatus of claim 20, wherein the connector includes an air inlet connection coupled to the bladder and a tube having a first end coupled to the air inlet connection and a second end configured to be coupled to the air supply.

24. An apparatus for use on a siderail of a bed, the apparatus comprising:

a bladder, a bladder-to-siderail fastener configured to couple the bladder to the siderail, and a connector configured to couple the bladder to an air supply, the bladder including an interior region configured to receive air from the air supply and a surface configured to be located adjacent a patient located on the bed, the surface being formed to include a plurality holes which allow a limited supply of air to escape from the interior region through the surface.

25. The apparatus of claim 24, wherein the fastener includes at least one strap coupled to the bladder, the at least one strap being configured to couple the bladder to the siderail.

26. The apparatus of claim 24, wherein the connector includes an air inlet connection coupled to the bladder and a tube having a first end coupled to the air inlet connection and a second end configured to be coupled to the air supply.

27. An apparatus for use on a siderail of a bed, the apparatus comprising:

a first air bladder including an interior region configured to receive air from an air supply, an inwardly facing surface configured to be located adjacent a patient located on the bed, and an outwardly facing surface, the inwardly facing surface including an air permeable surface configured to permit a limited amount of air to escape from the air bladder, and means for fastening the first air bladder to a siderail, and a connector configured to couple the first air bladder to the air supply.

28. The apparatus of claim 27, wherein the bed includes first and second spaced apart siderails, and the apparatus includes a second air bladder, the first and second air bladders coupled to the first and second siderails, respectively.

29. The apparatus of claim 27, wherein the air permeable surface includes a plurality of holes which allow a limited supply of air to escape from the interior region through the inwardly facing surface.

30. The apparatus of claim 27, further comprising a leg support air bladder having a bottom surface, a side wall, and a contoured top surface, the top surface of the leg support air bladder having a central elevated portion configured to define first and second spaced apart zones for receiving and separating first and second legs, respectively, of the patient.

31. The apparatus of claim 30, wherein the top surface includes opposite first and second elevated side portions, the central elevated portion being located between the first and second side elevated portions to form first and second recessed portions theybetween for receiving the first and second legs, respectively.

32. An apparatus for use on a siderail of a bed, the apparatus comprising:

a first air bladder including an air permeable surface configured to permit a limited amount of air to escape from the air bladder, means for fastening the first air bladder to a siderail, and a connector configured to couple the first air bladder to an air supply, and a leg support air bladder having a bottom surface, a side wall, and a contoured top surface, the top surface of the leg support air bladder having a central elevated portion configured to define first and second spaced apart zones for receiving and separating first and second legs, respectively, of the patient, the bed including an articulating deck having a foot section that is movable from a generally horizontal bed position to a generally vertical chair position, the leg support air bladder being coupled to the foot section of the deck and configured to be inflated when the deck is in its horizontal bed position and deflated when the deck is in its generally vertical chair position, and further comprising a cover surrounding the leg support air bladder, and an elastic cord coupled to the cover, the elastic cord being configured to gather the cover and the leg support air bladder toward the foot section of the deck as the leg support air bladder is deflated.

33. An apparatus for use on a patient support, the apparatus comprising:

a first cushion positioned on a deck of a patient support and a first air bladder coupled to a siderail of the patient support, the first air bladder including an interior region configured to receive air from an air supply, an inwardly facing surface configured to be located adjacent a patient located on the bed, and an outwardly facing surface, the inwardly facing surface including an air permeable surface configured to permit a limited amount of air to escape from the first air bladder.

34. The apparatus of claim 33, wherein the bed includes first and second spaced apart siderails, and a second air bladder, first and second air bladders coupled to the first and second siderails, respectively.

35. The apparatus of claim 33, wherein the a plurality of holes which allow the limited amount of air to escape from the interior region through the inwardly facing surface.

36. The apparatus of claim 33, further comprising a leg support air bladder having a bottom surface, a side wall, and a contoured top surface, the top surface of the leg support air bladder having a central elevated portion configured to define first and second spaced apart zones for receiving and separating first and second legs, respectively, of the patient.

37. The apparatus of claim 36, wherein the top surface includes opposite first and second elevated side portions, the central elevated portion being located between the first and second side elevated portions to form first and second recessed portions therebetween for receiving the first and second legs, respectively.

38. An apparatus for use on a patient support, the apparatus comprising:

a first cushion positioned on a deck of a patient support, a first air bladder coupled to a siderail of the patient support, the first air bladder including an air permeable surface configured to permit a limited amount of air to escape from the first air bladder, a leg support air bladder having a bottom surface, a side wall, and a contoured top surface, the top surface of the leg support air bladder having a central elevated portion configured to define first and second spaced apart zones for receiving and separating first and second legs, respectively, of the patient, and an articulating deck having a foot section that is movable from a generally horizontal bed position to a generally vertical chair position, the leg support air bladder being coupled to the foot section of the deck and configured to be inflated when the deck is in its horizontal bed position and deflated when the deck is in its generally vertical chair position, and further comprising a cover surrounding the leg support air bladder, and an elastic cord coupled to the cover, the elastic cord being configured to gather the cover and the leg support air bladder toward the foot section of the deck as the leg support air bladder is deflated.

* * * * *